US005378853A

United States Patent [19]

Clouet et al.

[11] Patent Number: 5,378,853

[45] Date of Patent: Jan. 3, 1995

[54] SHIELDED MULTIBRANCH HARNESS

[75] Inventors: Pascal Clouet, Gregy-sur-Yerres; François Vaille, Corbeil Essonnes; André Viaud, Crosne, all of France

[73] Assignee: Filotex, Draveil, France

[21] Appl. No.: 10,012

[22] Filed: Jan. 27, 1993

[30] Foreign Application Priority Data

Jan. 29, 1992 [FR] France ..... 92 00950

[51] Int. Cl.[6] ..... H01B 7/34

[52] U.S. Cl. ..... 174/36; 174/71 R; 174/72 R; 174/72 A; 439/497; 439/579

[58] Field of Search ..... 174/36, 71 R, 72 R, 174/72 A, 72 TR, 71 C; 439/571, 579, 497

[56] References Cited

U.S. PATENT DOCUMENTS

| | | | |
|---|---|---|---|
| 2,047,152 | 7/1936 | Mitchell | 174/36 |
| 2,166,420 | 7/1939 | Robertson | 174/72 A |
| 3,984,622 | 10/1976 | Ross | 174/72 A |
| 4,678,865 | 7/1987 | Sherwin | 174/36 |
| 4,822,956 | 4/1989 | Sepe | 174/36 X |
| 5,052,947 | 10/1991 | Brodie et al. | 439/607 X |
| 5,115,105 | 5/1992 | Gallosser et al. | 174/36 |
| 5,192,226 | 3/1993 | Wang | 439/502 |

FOREIGN PATENT DOCUMENTS

| | | |
|---|---|---|
| 0396932 | 11/1990 | European Pat. Off. . |
| 2520548 | 7/1983 | France . |

*Primary Examiner*—Morris H. Nimmo
*Attorney, Agent, or Firm*—Sughrue, Mion, Zinn, Macpeak & Seas

[57] ABSTRACT

The shielded harness has multiple branches and at least one fork, and has shielding braids over the various branches. The harness includes shielding continuity means over each fork, which means are constituted exclusively by enlarged tabs in the individual shielding braids of the various branches, each enlarged tab extending over the fork and beyond over another branch, and being covered by the shielding braid of said other branch.

14 Claims, 4 Drawing Sheets

SHIELDED MULTIBRANCH HARNESS

The present invention relates to shielded multibranch harnesses having a pre-established layout, the multiple branches serving a plurality of connection points and defining one or more forks between them. More particularly the invention relates to shielding such multibranch harnesses.

BACKGROUND OF THE INVENTION

Such a multibranch harness conventionally comprises a network of conductors (the network being continuous or optionally being made up of separate segments spliced together). The conductors are twisted together. The branches are connected in accordance with the pre-established layout, thereby constituting individual interactive links between the connection points.

There are a wide range of possible uses for such harnesses. In particular, they are used in land, air, or sea mobiles, for powering items of equipment on board the mobiles and for transmitting data signals between all or some of the items of equipment or appliances. In a good many applications, such harnesses need to have high-performance protection against electromagnetic interference, in addition to being strong enough to withstand considerable shocks, vibrations, and heat and/or chemical attack, in particular.

Independently from the problem of providing high-performance electromagnetic protection, the use of braiding is known for covering a network of conductors, mainly to provide cohesion therefor or to improve the overall strength thereof. Such braiding leaves the network relatively easy to handle so as to facilitate laying it and inserting it to the various points at which its branches are connected in the mobile in which it is used.

The overall-strength braiding is often a textile fabric, or is sometimes made of metal. In general, it provides the network with good mechanical properties, but cannot per se directly provide high electromagnetic protection, in particular at the forks.

To obtain high electromagnetic protection for the harness, two techniques are currently used for solving the problems of providing protection at the forks.

A first one of those techniques consists in using initially independent branches that are shielded individually by means of metal braiding, and in connecting them together in the desired layout by means of shielded splice boxes. The network is thus made up at the same time as the forks are shielded, by means of the splice boxes.

The shielded network obtained by using the first technique has excellent electromagnetic performance levels, due both to the uniformity of the initial shielded branches, which are equivalent to so many individual shielded cables, and to the low transfer impedance between each branch and the corresponding splice box. The network also has generally satisfactory mechanical properties. However, it is heavy, expensive, bulky, complex, and inflexible, due to it being made up from shielded cables constituting the branches that may have very different numbers of conductors and very different cross-sectional areas, and from splice boxes which are very often also different from one another.

The second technique consists in using a network of conductors, with the conductors co-operating with one another to define the different branches at the different forks in accordance with the layout of the harness, in shielding the branches by means of metal shielding braids made previously and threaded over each of the branches, and in threading heat-shrinkable metal-plated sleeves over the various forks to provide continuity in the shielding with the above-mentioned braids.

The shielded harness made by using the second technique offers advantages but also suffers from drawbacks compared with the harness made by using the first technique. The second harness is lighter in weight, less expensive, more compact, simpler, and more flexible. However, with the second technique, the electromagnetic performance levels of the harness are poor and often insufficient, as are its mechanical properties, in particular its ability to withstand vibration which, as a result, reduces the electromagnetic protection provided.

The low performance levels are partly a result of the braids being threaded on, which deforms their shape and gives rise to relative displacement of the braiding wires, with gaps or holes being created between the wires. Such defects prevent intimate contact between the wires in each braid, and are accentuated when in the presence of vibration which causes the wires to be displaced relative to one another and on the conductors in the network. Such displacement gives rise to abrasion, whereby the insulation on the conductors is degraded.

The low performance levels are also a result of the electrical contacts between the sleeves and the braids being inadequate and/or being degraded under the conditions in which the harness is used. This is due to the contact surfaces being small and to the material of which the sleeves are made being different from the material of which the braids are made, thereby giving rise to prohibitive transfer impedance levels at the forks.

Furthermore, independently from the electromagnetic shielding of the network of conductors, and from the continuity in shielding over the forks, those two techniques require end connectors to be connected subsequently to the harness, at the ends of the various branches, and electromagnetic protection to be provided at the rear connection ends of the connectors. Mounting and electromagnetically protecting the connectors involves handling the shielding braids of the branches roughly so as to thread them over the rear ends of the connectors and to lock them thereon. Such rough handling irretrievably degrades the shape of the braid, and does not enable satisfactory continuity in shielding to be obtained between the connectors and the network of conductors, at least for some uses of the harnesses.

An object of the present invention is to avoid the drawbacks of shielded multibranch harnesses that are made by using those known techniques.

SUMMARY OF THE INVENTION

The invention provides a shielded multibranch harness including a network of conductors defining the multiple branches and at least one fork between said branches in a given pre-established layout, shielding braids for shielding said branches, and first shielding continuity means over each fork, wherein said first shielding continuity means over each fork are constituted exclusively by enlarged tabs in the shielding braids made successively over the various branches in question of the fork, each enlarged tab extending over the fork and over at least a portion of another one of said branches in question other than the branch carrying the shielding braid to which the enlarged tab in question belongs, and each enlarged tab being covered by the shielding braid of one of said other branches in question, with the exception of the enlarged tab of the last braid made which is not covered.

The harness of the present invention further has at least one of the following additional features:

the last shielding braid made at each fork is continuous over two of the branches of the fork and constitutes the shielding braid for one of the two branches, the enlarged tab of which shielding braid covers the entire length of the other one of the two branches;

the last shielding braid made at each fork includes a starting enlarged tab forming a double self-locking hem for itself and for the underlying portions of the shielding braids made prior to the last shielding braid;

each shielding braid and the enlarged tab of the braid in question both have their number of braiding wires and their braiding pitch adapted to the cross-sectional dimensions of the branch which the shielding braid in question covers, or both have their number of braiding wires adapted in this way, with the shielding braid having a braiding pitch adapted to the cross-sectional dimensions of the branch which it covers, and the enlarged tab having a braiding pitch adapted to the cross-sectional dimensions of the other branch which it covers, at least in part;

the branches have integrated end connectors, each connector having its end that is connected to the branch covered by the shielding braid of the branch, which shielding braid is preformed directly over the connector; and each of the branches that are not connected to end connectors is equipped with an expander positioned at the location in which the connector is to be connected, and covered by the shielding braid of the branch, which shielding braid is preformed directly over the expander and to the dimensions thereof.

BRIEF DESCRIPTION OF THE DRAWINGS

The characteristics and advantages of the present invention will appear on reading the following description of embodiments given with reference to the accompanying drawings, in which.

MORE DETAILED DESCRIPTION

The shielded multibranch harness of the present invention comprises a network of conductors, the network having multiple branches and at least one fork, disposed in a pre-established layout.

Figure 1A:
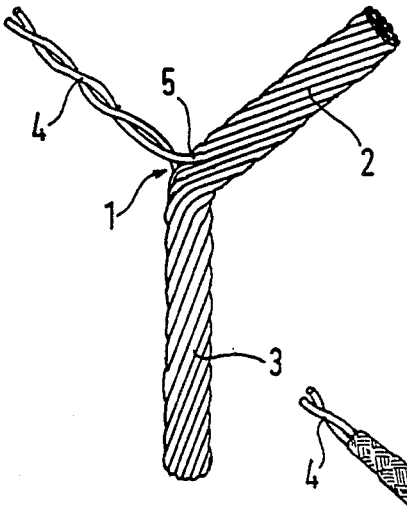
FIGS. 1A, 1B, 1C, 1D, 1E and 1F show the steps by means of which electromagnetic shielding continuity is provided over a multibranch harness having at least one fork, in accordance with the present invention.

FIG. 1A shows one fork 1 of said harness, which fork is defined by the network of conductors and has three branches 2, 3, 4 leading off from the fork. The conductors are twisted-together over each branch, and one of the conductors is referenced 5. They are continuous from one branch to another. They are insulated by means of insulating coverings. The network is initially bare.

In FIG. 1A, branch 4 is shown as having two conductors. Branches 2 and 3 have the same larger number of conductors and the same cross-sectional dimensions as each other.

Figure 1B:
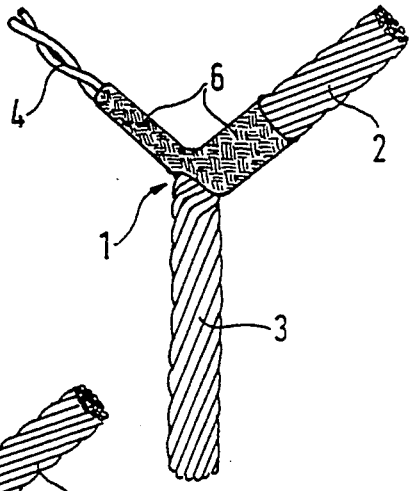
Figure 1C:
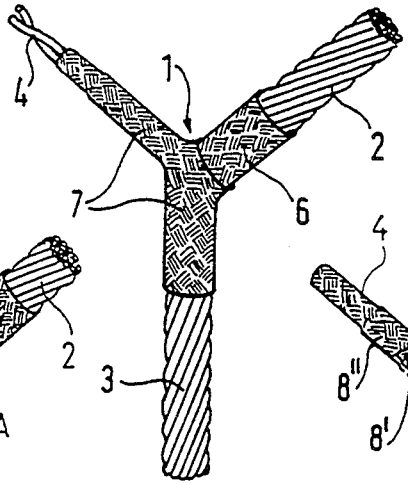

FIGS. 1B to 1C show two preliminary but not essential treatment steps for the fork 1. These steps are desirable when the branches have very different numbers of conductors, and therefore very different cross-sectional dimensions. The preliminary steps consist in making lagging braids 6 and 7 over the fork 1 and over the adjoining portions of the branches. The lagging braids are made successively by taking the branches in pairs and making a double lagging braid over the branch having the smaller cross-sectional dimensions. Each lagging braid has a number of braiding wires and a braiding pitch that are adapted to the diameter of the portion that it covers of the smaller-diameter branch. In a variant, the braiding pitch varies so that it is adapted to the successive portions that are covered by the lagging braid. The lagging braid filaments may be textile threads, but they are preferably metal wires.

In this way, in FIG. 1B, the first lagging braid 6 starts from branch 2, covers almost the entire fork 1, and extends over the adjoining portion of branch 4. The number of braiding wires and the pitch are adapted to the cross-sectional dimensions of branch 4. Advantageously, branch 2 is properly lagged by reducing the braiding pitch. The braiding pitch is greater over branch 4 than over branch 2.

In FIG. 1C, the second lagging braid 7 starts from branch 3, and extends over branch 4 by covering preferably the entire length of the first lagging braid 6 over branch 4. The second lagging braid is made in the same way as the first lagging braid 6.

Figure 1D:
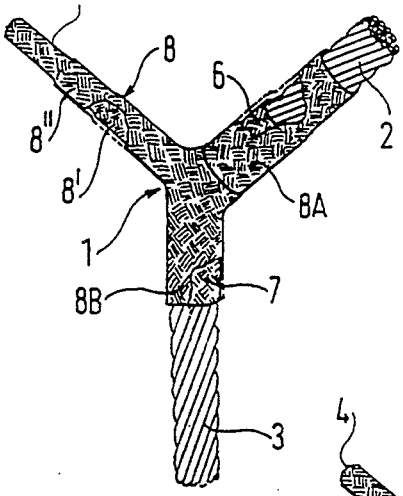
Figure 1E:
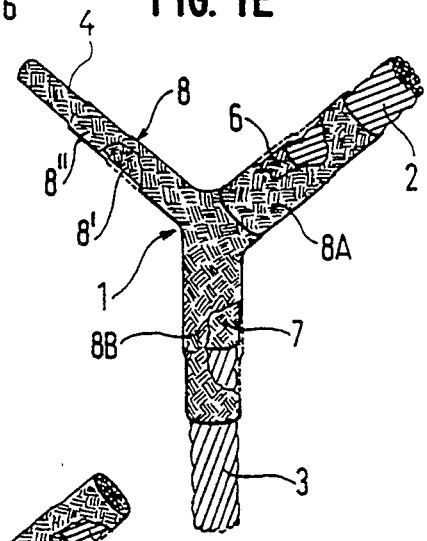
Figure 1F:
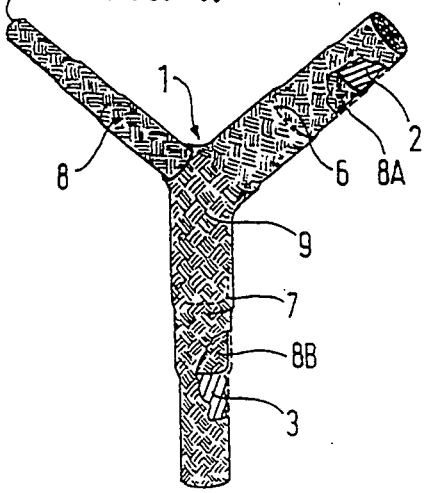

FIGS. 1D, 1E and FIG. 1F show the two shielding steps for the three branches 2, 3, and 4 and for their fork 1. Shielding is provided exclusively by first and second shield continuity means formed by metal shielding braids 8 and 9, respectively for shielding the branches, which braids are made successively, in order of increasing branch cross-sectional dimensions.

To shield the fork, each shielding braid, such as 8, for one of the branches has at least one enlarged tab or extension, such as 8A, 8B, covering the fork 1 and extending beyond the fork over an adjoining portion of at least one of the other branches.

Each shielding braid, with the possible exception of the last shielding braid, is preferably made starting from one of the other branches so as to make the enlarged tab or extension of the shielding braid first. The last shielding braid 9 gives the appearance of shielding continuity, in particular over the fork.

Shielding braids 8 and 9 are single-layer or multilayer. One of the multiple layers or each layer has an enlarged tab over another branch. The enlarged tabs or extensions of the various multiple layers may extend over the same other branch or preferably over different other branches.

In FIGS. 1D and 1E the first shielding braid 8 is made over the branch 4 having the smallest cross-sectional dimensions. The braid is made in two layers 8′ and 8″ over the branch 4, each layer having a respective enlarged tab or extension 8A, 8B. Enlarged tab 8A of layer 8′ extends over branch 2 and the enlarged tab 8B of the layer 8" extends over branch 3. One of the two enlarged tabs covers the other over fork 1. The shielding braid 8 covers the portions of the lagging braids 6 and 7 on branch 4 entirely. The enlarged tabs 8A and 8B cover the portions of the lagging braids 6 and 7 on branches 2 and 3 either entirely or in part.

As with the lagging braids, the enlarged tabs and the shielding braid 8 for the branch 4 have numbers of braiding wires and braiding pitches that are adapted to the cross-sectional dimensions of the branch 4 that is covered by the shielding braid 8. Since branches 2 and 3 have cross-sectional dimensions that are considerably larger than those of branch 4, each layer of the shielding braid 8 is made starting with its enlarged tab over branch 2 or 3, with the number of wires being adapted to the cross-sectional dimensions of branch 4, and with the braiding pitch being smaller and adapted to the cross-sectional dimensions of the branch 2 or 3 in question.

In FIG. 1F, the last shielding braid 9 is made continuously over the last two branches 2 and 3 having the largest cross-sectional dimensions. The last shielding braid covers the enlarged tabs of the previous shielding braids and the fork 1.

It should be noted that the last shielding braid 9, for the last two branches 2 and 3, has a construction and a braiding pitch which are different from the previous shielding braids, and which are adapted to the diameter of the branches 2 and 3 that are covered by it. Where applicable, the last shielding braid may in turn have an enlarged tab over and beyond another possible fork defined on either one or both of the branches 2 and 3.

The successive shielding operations are conducted systematically over the branches of the same fork, and from one fork to another along the harness. In this way, at each fork, all the enlarged tabs of the shielding braids are entirely covered by the following shielding braids, thereby co-operating with the last shielding braid made to give a uniform and continuous appearance to the shielding.

The shielding, which is provided exclusively by the shielding braids, gives the shielded harness weight, flexibility, compactness, electromagnetic protection, and mechanical strength that are optimum. The cost of the harness remains less than the cost of a prior art shielded harness having splice boxes (as indicated), and the electromagnetic performance levels of the harness are a considerable improvement over those of a prior art shielded harness having metal-plated shrinkable sleeves (as indicated).

Figure 2:
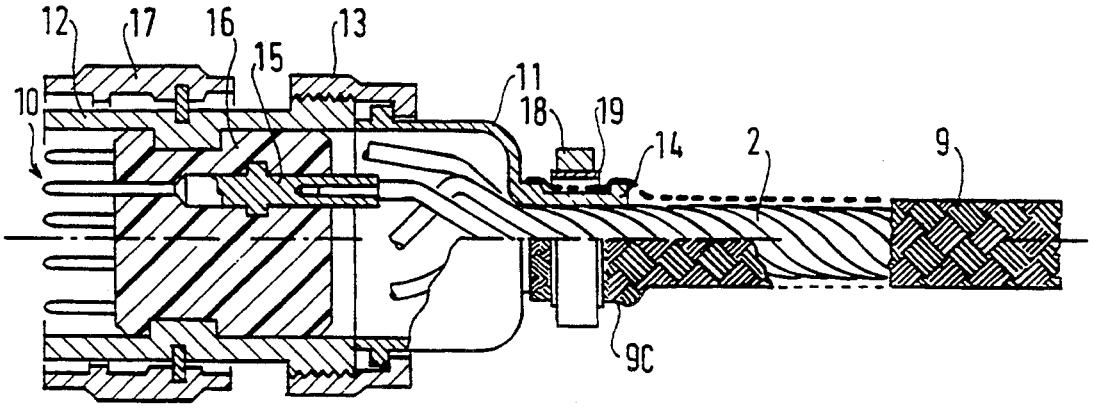
FIG. 2 is a view partially in section of one of the branches of the shielded harness shown in FIGS. 1A to 1F, the branch being equipped with an end connector integrated into the harness.

FIG. 2 shows one of the above-mentioned branches, in this case branch 2, to which an end connector 10 is connected.

The connector is known per se, but is integrated into the branch 2. It is connected to the end of branch 2 before the harness is shielded, or at least before branch 2 is shielded.

The connector has a body made in two portions, namely a rear portion 11 and a front portion 12, which are assembled together by means of a link nut 13.

The rear portion delimits a chamber in which the twisted-together conductors making up the branch 2 are splayed out and distributed, the surplus length of the conductors optionally being cut off. The rear portion has a rear end which forms a rear collar 14 via which the conductors are inserted into the chamber.

The front portion 12 includes a plurality of contacts 15 mounted and retained in an insulating block 16, the conductors of the branch 2 being connected to the contacts. The contacts also project from the insulating block at the front face of the connector. A front peripheral nut 17 on the connector locks it to a complementary connector at the point at which the branch is connected.

The shielding braid 9 of the branch 2 has an additional enlarged tab 9C made continuously therewith directly over the rear collar 14 of the connector 10 previously connected to the branch 2.

Enlarged tab 9C is subsequently locked onto the collar by suitable fixing means, such as a clamping ring 18 or a clamping clip. For example, the fixing means are made of metal, have shape memory, and are shrinkable by means of cryogenics or magnetostriction, in particular. A protective flexible metal strip 19 may be interposed between the fixing means and enlarged tab 9C, over the ends of the wires in enlarged tab 9C, to avoid holes being pierced by the ends of the wires.

Figure 3:
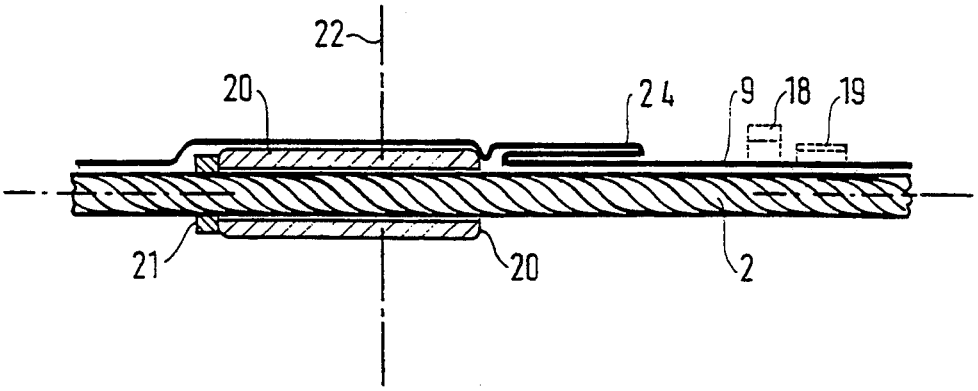
FIG. 3 is a diagrammatic view of a variant on FIG. 2, with a branch of the harness being pre-equipped so that the above-mentioned connector can be subsequently mounted thereon.

FIG. 3 is a variant on FIG. 2. In this variant, branch 2 has no end connector, but it is pre-equipped with an expander 20 for the purposes of subsequently mounting the connector after the branch 2 has been shielded, and after the entire harness of which the branch is part has been shielded.

The expander 20 is positioned at the location at which the connector is to be subsequently connected. The shielding braid 9 is then made during the same braiding operations, with the expander being in place on the bundle of twisted-together conductors making up the branch 2.

Advantageously, a positioner 21 is retained substantially at the ends of the twisted-together conductors of the branch 2. The positioner serves as a front abutment for the expander, which is then properly positioned, and prevents the expander from moving forwards or coming out from underneath the shielding braid both during the braiding operations and subsequently.

The cross-sectional dimensions of the expander are as close as possible to being the same as those of the rear end of the connector. The "rear" end 5A of the expander, which end is the innermost one along the branch, is shaped and has a rounded or conical shape. This shape ensures a smooth and gradual transition for the shielding braid between the expander and the bundle of twisted-together conductors, the expander and the bundle being of different cross-sectional dimensions.

The expander is made of a hard material, which may be metal or plastic.

The expander may be re-used many times, in particular when it has a complex shape, and is then relatively expensive.

The shielding braid 9 is made in one layer or in a plurality of layers one on top of another, and is made continuously over the length of the end portion which is already carrying the expander. The braid is thus preformed to the cross-sectional dimensions of the expander, and therefore to the cross-sectional dimensions of the rear end of the connector. Braiding may be performed with braiding pitches on the expander and on the bundle of conductors that are different, with a continuously varying pitch at the transition, so that where, applicable, and in particular when there is a large difference between the cross-sectional dimensions of the expander and those of the bundle, high-performance protection is obtained over the entire length of the branch, including the length over the expander.

The shielding braid 9 may either cover the entire expander, or only cover part of it. Since the braid is preformed to the cross-sectional dimensions of the rear end of the connector, it avoids any rough handling that may degrade the characteristics of the braid when the connector is being installed.

The expander 20 further serves as an abutment surface for cutting the shielding braid 9 to the right length. The expander also protects the conductors it covers from being damaged when the braid is being cut. The plane on which the shielding braid is cut is referenced 22, and is situated at a distance from the rear end of the expander that is substantially equal to the length of the rear connection end of the connector. The braid is cut to enable the surplus length of braid to be removed, and the expander to be withdrawn, so that the rear end of the connector can be slid into place under the shielding braid without deforming it.

Advantageously, fixing and protection accessories are initially provided on the end portion pre-equipped ready for the connector to be installed, or they are mounted after the surplus length of shielding braid has been cut off and the expander has been removed. The fixing and protection accessories are shown by dashed lines and are given the same references as in FIG. 2. For example, the accessories comprise a shrinkable fixing ring 18, or an analogous component, a protective flexible metal strip 19, and also sheaths and sleeves made of heat-shrinkable material, which sheaths and sleeves are used subsequently to provide transverse sealing for the resulting assembly.

Advantageously, the shielding braid 9 further includes a self-locking loop 24 made with the braid. The loop almost adjoins the rear end 20A of the expander, and extends, for in the range one centimeter to a few centimeters, over the bundle of twisted-together conductors of the branch 2. The loop is obtained by means of go-and-return braiding motion, while the braid is being made, so as to form a double hem.

The loop prevents the shielding braid from slipping on the conductors and/or prevents any multiple layers in the shielding braid from slipping on one another, in particular when the surplus length of the braid is being cut off, and the connector is being installed and connected. The loop acts directly as a fixing ring for fixing the shielding braid on the bundle of conductors. It also opposes any relative displacement of the shielding braid and of the bundle that may occur when they are mechanically urged by vibration under certain conditions of use, thereby avoiding any rubbing and resulting degradation of the conductor insulators.

In FIGS. 4 to 9, the same references as those used in FIG. 1 are used to designate identical or analogous elements, the references sometimes being followed by the prime symbol or the double prime symbol, and any differences between the elements being specified. The axes of the branches are represented by dot-dash lines and referenced by Roman numerals corresponding to the references of the respective branches. The bundle of conductors in each branch, or the branch that they define, is represented by a solid line along each axis. Each braid, or each of its layers, or each additional element on each branch is shown in axial half section and represented by a single line, i.e. without thickness. The lines representing the axial half-sections of the various layers of the braids are situated on one or other side of the branch or of the line delimiting the branch to facilitate understanding, and to make the figures clearer.

A dash drawn across one end of each braid or each layer indicates the point at which braiding starts, and an arrow at the other end indicates both the braiding direction and the point at which braiding stops.

Figure 4:
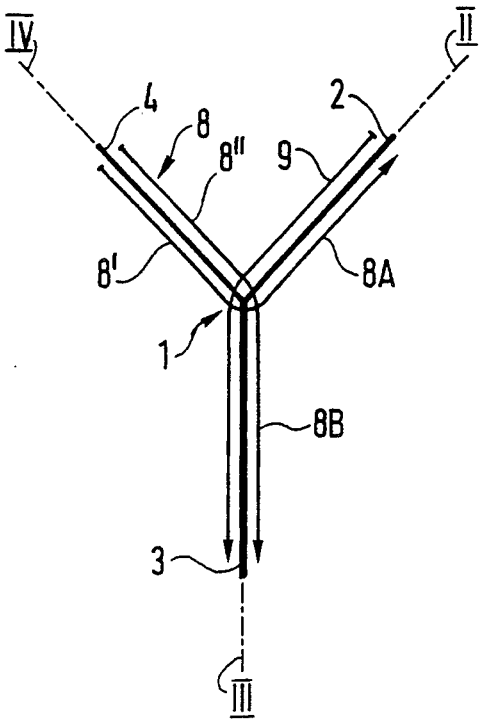
FIGS. 4 to 9 are highly diagrammatic views corresponding to variants given on FIGS. 1A to 1F.

FIG. 4 corresponds to a first variant embodiment of the shielding, when the three branches 2, 3, and 4 of the fork 1 have substantially the same cross-sectional dimensions. The fork then has no lagging braid. The shielding braid of branch 4 is made in two layers 8' and 8'' whose enlarged tabs 8A on branch 2 and 8B on branch 3 extend over the entire lengths of branches 2 and 3. The last shielding braid 9 over branches 2 and 3 is shown as having a single layer which overlies the enlarged tabs 8A and 8B.

Figure 5:
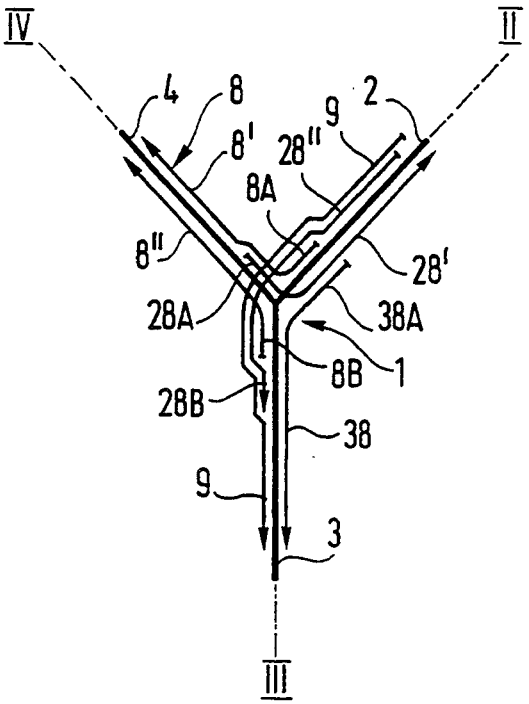

FIG. 5 corresponds to a second variant embodiment of the shielding, when all the branches have different cross-sectional dimensions, with the cross-section of branch 2 being considerably smaller than that of branch 3 but considerably larger than that of branch 4. The fork is shown without any lagging braid. The absence of lagging is compensated by a preliminary shielding layer 28' for the branch 2 of intermediate cross-section, the preliminary layer having an enlarged tab 28A over the branch 4 of smallest cross-section.

Each of the three branches is then treated in order of increasing branch cross-section, and is covered with an individual shielding braid. Each shielding braid is made in two layers 8' and 8'' over branch 4, with enlarged tabs 8A and 8B over branches 2 and 3, in an additional layer 28'' over branch 2, overlying the above-mentioned layer 28' and having an end enlarged tab 28B over branch 3, and firstly in a layer 38 over branch 3 with a starting enlarged tab 38A on branch 2. The last shielding braid 9 essentially provides additional shielding for the last branch 3 to be treated. The last braid is made continuously over the branches 2 and 3 having the largest cross-sections.

Figure 6:
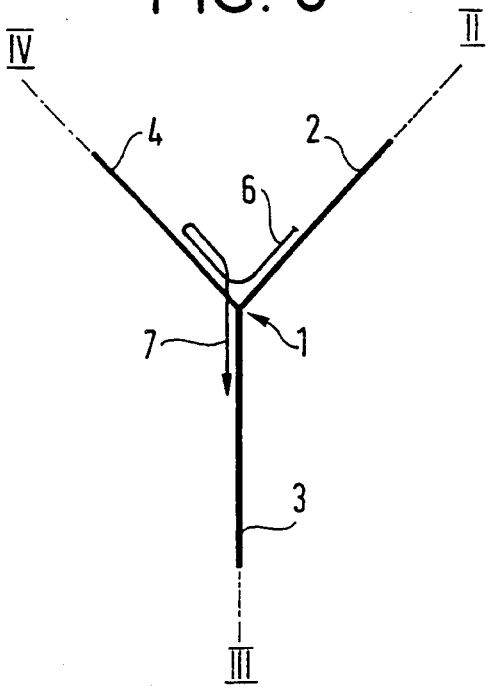

FIG. 6 is a variant on FIGS. 1B and 1C, with respect to lagging the fork 1. Lagging is performed in a single braiding operation over all three branches, with the resulting single lagging braid being equivalent to the two above-mentioned lagging braids 6 and 7, and being designated by both these references. Lagging is performed from branch 2 to branch 4, with go and return motion over branch 4, and stopping on branch 3.

Figure 7:
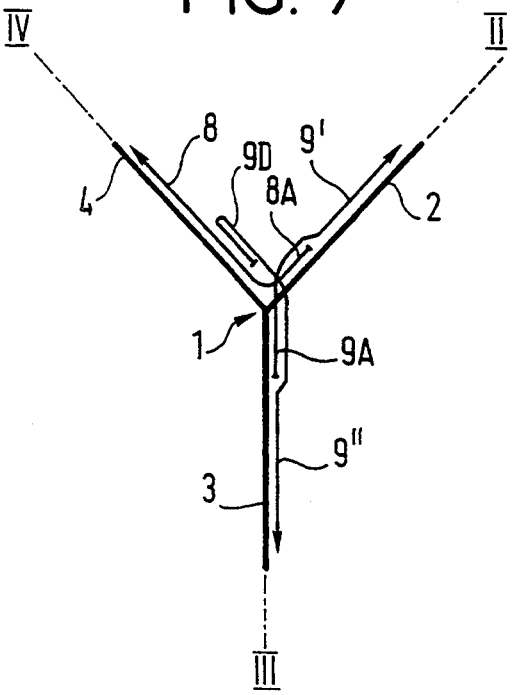

FIG. 7 is a variant on FIG. 1E, with respect to making the shielding braids for each of the branches, regardless of whether lagging braids are present on the fork 1. Each of the shielding braids is made in one layer over the branch in question. The shielding braid 8 of the branch 4 having the smallest cross-section is the first to be made, and it has an enlarged tab 8A over the next branch 2 to be treated.

The shielding braid 9' of branch 2 has an enlarged tab 9A over branch 3. The shielding braid 9'' of branch 3 has a specific starting enlarged tab 9D over the branch 4 having the smallest cross-section. The two shielding braids 9' and 9'' are equivalent to the final continuous braid 9 in FIG. 1E, due to the presence of the specific enlarged tab 9D.

The specific starting enlarged tab 9D is made with limited go motion over branch 4 substantially from the fork 1, and then return motion back to the fork 1 and beyond it so that the shielding braid 9'' is made directly after the enlarged tab. The enlarged tab forms a self-locking hem on branch 2 for locking braids 9' and 9'', and braid 8.

Figure 8:
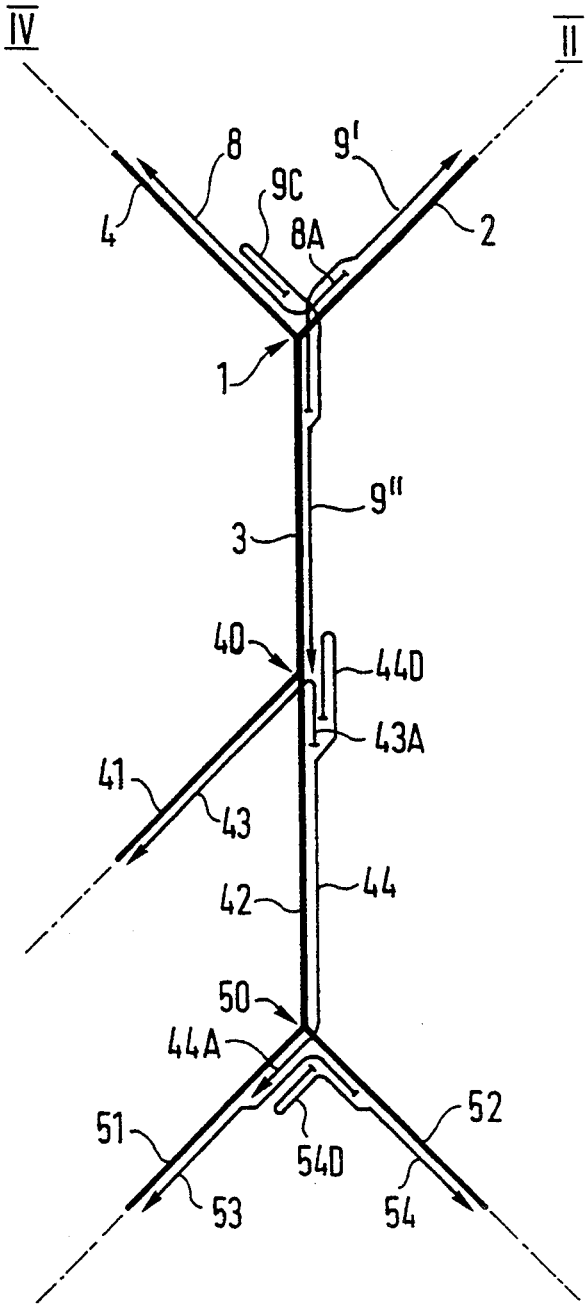

FIG. 8 shows a harness which, in addition to the above-mentioned fork 1 with its three branches 2, 3, and 4 that are shielded as shown in FIG. 7, has another fork 40 on branch 3 with two new branches 41 and 42 leading off therefrom, and a new fork 50 on branch 42, with two other new branches 51 and 52 leading off therefrom.

The braiding method used for the branches at each fork is carried over from one fork to the next along the harness.

Shielding braid 9'' is shown stopped at the fork 40. In a variant this braid may have a final enlarged tab extending over the start of branch 41 which is smaller in cross-section than branch 42. Branch 41 is covered with its shielding braid in a single layer 43 having a starting enlarged tab 43A over branch 42. Branch 42 is in turn covered with its shielding braid in a single layer 44, with a starting enlarged tab 44D made in the form of a hem on either side of fork 40 over branches 42 and 3. Shielding braid 44 has a final end enlarged tab 44A beyond fork 50, on branch 51 in this example.

Shielding braids 53 and 54 for branches 51 and 52 are made as described above, with the last shielding braid 54 for treating the branches from the fork 50 having a starting enlarged tab 54D in the form of a hem.

Figure 9:
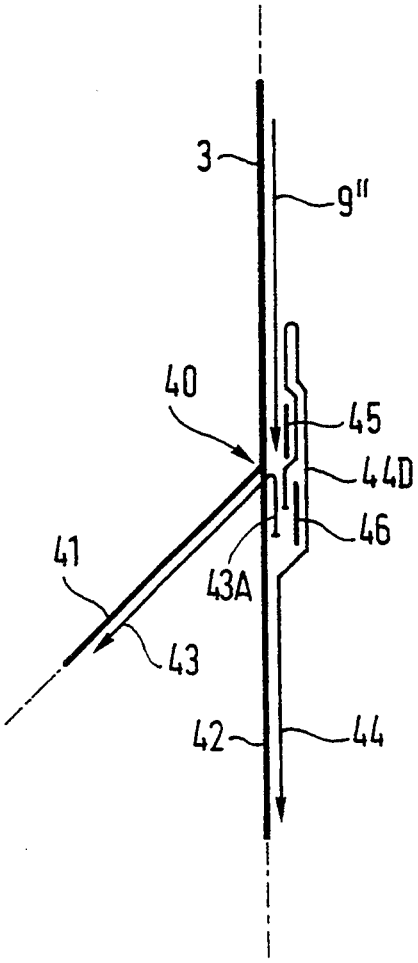

FIG. 9 shows a variant with respect to further treatment performed where the shielding braids start or stop. This variant is given with respect to FIG. 8 and to fork 40 shown in FIG. 8, but the further treatment is applicable to any end of any one of the shielding braids which is subsequently covered by another shielding braid, and in particular by the last shielding braid of the branches of the same fork.

The further treatment consists in disposing a metal strip 45 around the end of the shielding braid 9'' stopped just before the fork 40, and in disposing a metal strip 56 around the end of the enlarged tab 43A of the shielding braid 43. Strip 46 also preferably covers the starting end of enlarged tab 44D when said tab forms a hem. The strips prevent the ends of the wires, or of their strands, which ends turn up naturally or have outwardly-projecting points, from piercing through the shielding braids overlying them, or through any additional outer sheathing, in particular insulating sheaths.

The metal strips are advantageously adhesive so that they remain properly in place on the ends of the braids in question.

We claim:

1. In a shielded multibranch harness including a network of conductors defining the multiple branches and at least one generally Y-shaped fork formed by first, second and third ones of said branches in a given pre-established layout, a plurality of shielding braids for shielding said branches, at least two of said branches having different cross-sectional dimensions, and first shielding continuity means over said fork, the improvement wherein said first shielding continuity means are defined exclusively by an enlarged tab in each of the shielding braids that are made in succession over the first, second and third branches of the fork, each enlarged tab extending over the fork and over at least a portion of another one of said three branches other than the branch carrying the shielding braid to which an enlarged tab belongs, and each enlarged tab being covered by the shielding braid of one of said other branches, with the exception of the enlarged tab of the last-made braid, which is not covered.

2. A shielded harness according to claim 1, wherein each enlarged tab of each shielding braid, except the last shielding braid made, extends over one of the other branches having at least the same cross-sectional dimensions as the branch carrying the shielding braid to which the enlarged tab belongs.

3. A shielded harness according to claim 1, wherein each enlarged tab and the braid to which the enlarged tab belongs either both have their number of braiding wires and their braiding pitch adapted to the cross-sectional dimensions of the branch which the shielding braid covers, or both have their number of braiding wires adapted in this way, with the enlarged tab having a braiding pitch adapted to the cross-sectional dimensions of the branch which it covers, and the shielding braid having a braiding pitch adapted to the cross-sectional dimensions of the branch which it covers.

4. A shielded harness according to claim 1, wherein the enlarged tab of at least said last braid made is made continuous over the entire length of the other branch over which it extends.

5. A shielded harness according to claim 1, wherein the enlarged tab of the last braid made is a double self-locking hem extending over one of the other branches in question of the fork.

6. A shielded harness according to claim 1, wherein said shielding braids are constituted by at least one layer.

7. A shielded harness according to claim 1, including at least one protective metal strip between one of the shielding braids and the underlying end of one other shielding braid.

8. A shielded harness according to claim 1, further including end connectors connected at the ends of at least some of the multiple branches, and second shielding continuity means over a rear end of each connector, wherein said second shielding continuity means are constituted exclusively by an additional enlarged tab of the shielding braid of the branch to which the connector is connected, said additional enlarged tab being made directly over the rear end of the connector and locked on said rear end, thereby integrating the connector into said shielded harness.

9. A shielded harness according to claim 1, further including an expander on each branch that is not initially connected to an end connector, the cross-sectional dimensions of the expander being substantially identical to those of a "rear" end of said connector to be connected, the expander being mounted substantially at the location of the connector to be connected to the branch and covered directly by the shielding braid on the branch, the shielding braid being directly preformed at the expander and to the dimensions thereof.

10. A shielded harness according to claim 9, further including an end abutment positioner associated with and mounted at the end of said expander on the branch carrying said expander.

11. A shielded harness according to claim 9, wherein the shielding braid over each branch equipped with an expander has a self-locking loop substantially adjoining said expander and extending towards the fork over a portion of the branch.

12. A shielded harness according to claim 1, in which at least some of said branches at the same fork have different cross-sectional dimensions from one another, and wherein said harness further includes at least one lagging braid over the fork and on either side over the adjoining portions of all or part of the branches.

13. A shielded harness according to claim 12, including a plurality of lagging braids each extending on either side the fork over two different branches.

14. A shielded harness according to claim 13, including a lagging braid made continuously starting from one of the branches over at least two other branches of the fork, with go-and-return motion over one of them.

* * * * *